United States Patent [19]

Roussin et al.

[11] Patent Number: 4,679,857

[45] Date of Patent: Jul. 14, 1987

[54] MOUNTING FRAME FOR LINEAR IMPACT RIPPER ASSEMBLY

[75] Inventors: Michael A. Roussin, Peoria; Jerry D. Fidler, East Peoria; Brian D. Jensen, Dunlap, all of Ill.

[73] Assignee: Caterpillar Inc., Peoria, Ill.

[21] Appl. No.: 906,681

[22] Filed: Sep. 11, 1986

Related U.S. Application Data

[63] Continuation-in-part of Ser. No. 765,732, Aug. 13, 1985, abandoned.

[51] Int. Cl.[4] ..... E21C 37/20

[52] U.S. Cl. ..... 299/37; 299/33

[58] Field of Search ..... 299/33, 37; 173/29, 173/46, 49

[56] References Cited

U.S. PATENT DOCUMENTS 4,229,044 10/1980 Cobb et al. ..... 299/37

4,229,046 10/1980 Gurries ..... 299/14 X 4,453,772 6/1984 Roussin ..... 299/37

*Primary Examiner*—Stephen J. Novosad

*Assistant Examiner*—Thomas J. Odar

*Attorney, Agent, or Firm*—Calvin E. Glastetter

[57] ABSTRACT

A mounting arrangement for a linear impact ripper pivotally connected to a support frame and including an elongated torque tube or crossbeam having a pair of forwardly extending end plates pivotally mounting the crossbeam to the support frame. A pair of impactor mounting plates extend downwardly from the cross beam and position a linear reciprocating impact hammer therebelow. A pair of ripper shank mounting plates extend forwardly from the crossbeam to provide a pivot mounting for a ripper shank. The mounting frame transfers forces from the individual components into the crossbeam for effectively minimizing the transfer of shock forces from the ripper assembly to the vehicle.

10 Claims, 9 Drawing Figures

MOUNTING FRAME FOR LINEAR IMPACT RIPPER ASSEMBLY

This is a continuation-in-part of Ser. No. 765,732, filed Aug. 13, 1985, now abandoned.

DESCRIPTION

1. Technical Field

This invention relates to impact rippers of the type carried on the rearward end of an earthmoving vehicle, and more particularly to a mounting frame for a linear impacting ripper assembly.

2. Background Art

In one form of conventional earth penetrating ripper, a shank is pivotally mounted to an elevationally adjustable support structure carried on the rear of an earthworking vehicle. As a result of the shank moving through the earth and impacting rocks and other obstructions, the mounting frame must withstand relatively high forces. In U.S. Pat. No. 4,453,772 by Roussin, forces created by the ripper element pivoting rearwardly must be absorbed by the impactor apparatus and all forces from the individual components must be absorbed by the two swivel pins. The present invention is directed to overcoming one or more of the problems as set forth above.

3. Disclosure of the Invention

In one aspect of the present invention a mounting frame for an impact ripper is shown having an elevationally adjustable support frame with a torque tube or crossbeam connected thereto. End plates on the crossbeam extend forwardly for pivotal connection to the support frame. Impactor mounting plates extend downwardly from the crossbeam to provide a mount for a linear reciprocating impact hammer. Ripper shank mounting plates on the crossbeam extend forwardly for providing a pivot mounting and directing ground engaging forces into the crossbeam.

In another aspect of the present invention a mounting frame for an impact ripper is shown having an elevationally adjustable support frame with a crossbeam connected thereto. A pair of end plates on the crossbeam extend forwardly for pivotal connection to the support frame. A pair or ripper shank mounting plates are mounted on the crossbeam and extend forwardly. A pair of impactor mounting plates are mounted on the crossbeam outwardly of the ripper shank mounting plates and extend rearwardly. A shank pivot mounting on the shank mounting plates is adapted for supporting the ripper shank.

In still another aspect of the present invention a mounting frame for an impact ripper is shown having an elevationally adjustable support frame with a crossbeam connected thereto. A pair of end plates on the crossbeam extend forwardly for pivotal connection to the support frame. A mounting structure is mounted on the crossbeam intermediate the end plates. The mounting structure includes a forwardly extending pair of ripper shank mounting plates mounted on the crossbeam and a rearwardly extending pair of impactor mounting plates mounted outwardly on the ripper shank mounting plates. A shank pivot mounting on the shank mounting plates is adapted for supporting the ripper shank.

BEST MODE FOR CARRYING OUT THE INVENTION

Figure 1:
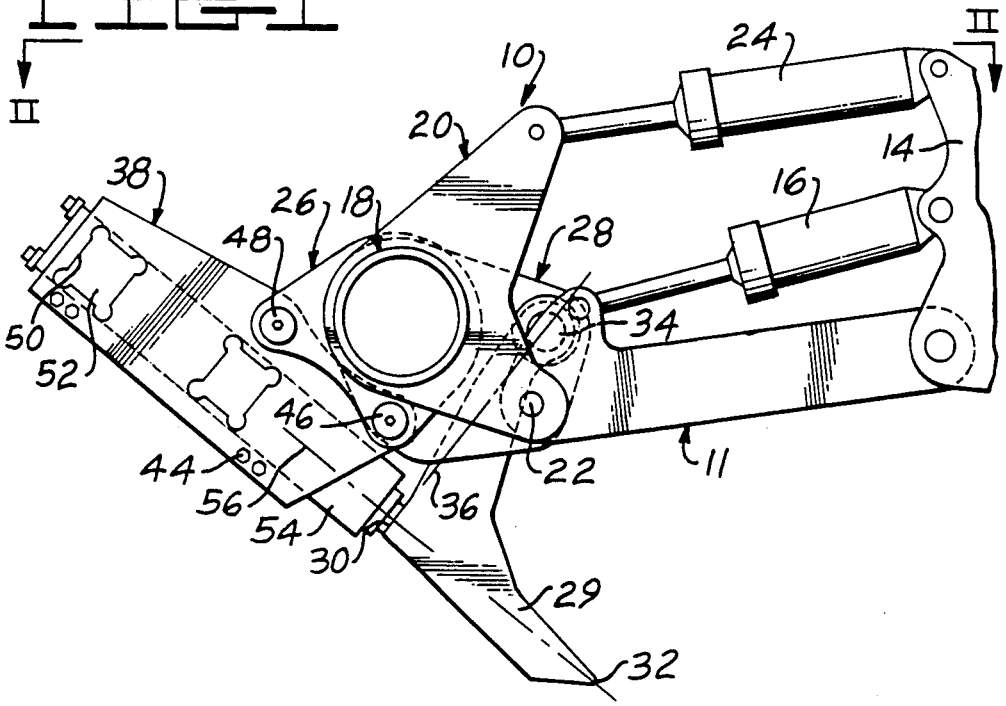
FIG. 1 is a side elevational view of a mounting frame for a linear impact ripper assembly.
Figure 2:
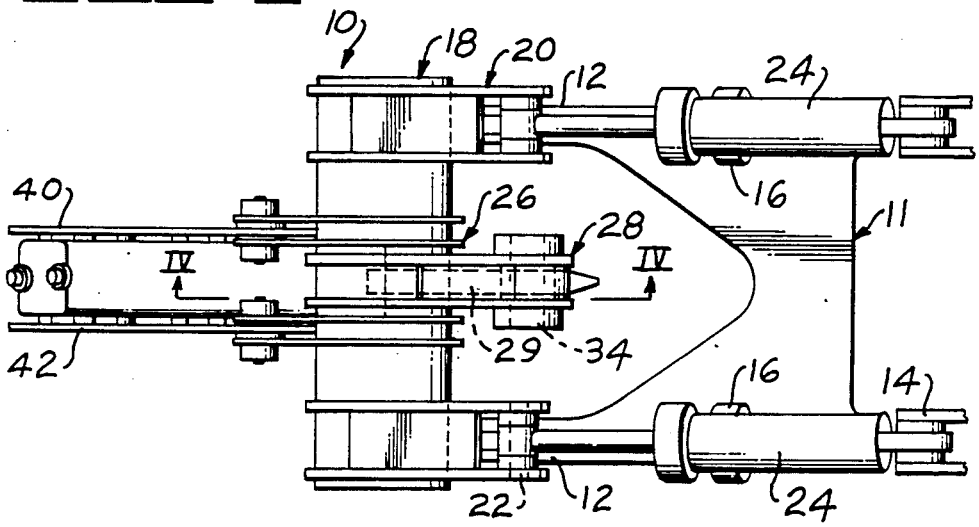
FIG. 2 is a top elevational view of the mounting frame for a linear impact ripper assembly.
Figure 3:
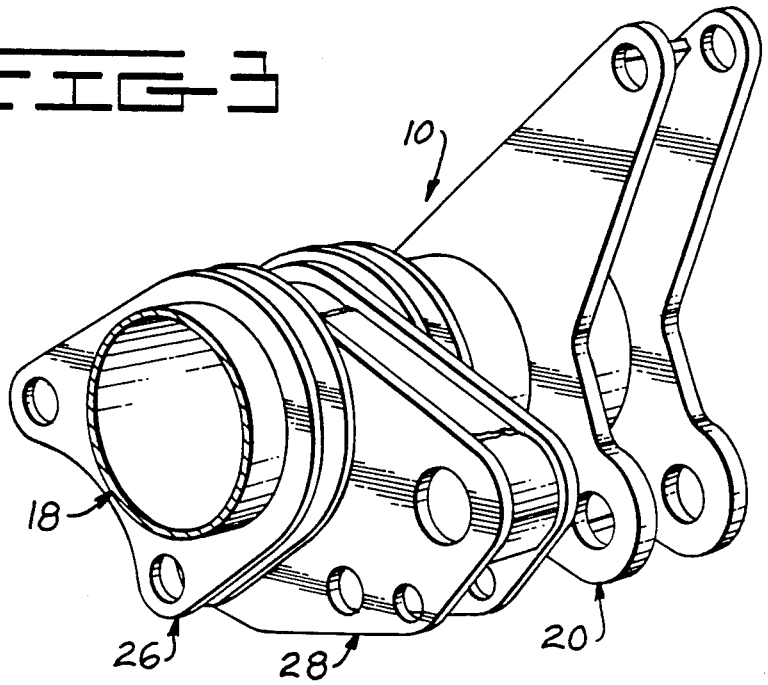
FIG. 3 is an isometric view showing the construction of the mounting frame of the preceding Figs.

In the illustrated embodiment of the invention as disclosed in FIGS. 1, 2 and 3, a linear impact ripper mounting structure 10 is mounted on an elevationally adjustable support frame 11 having a pair of rearwardly extended transversely spaced legs 12 which are attached to a bracket 14 on a vehicle (not shown). The support frame 11 is elevationally adjusted by a pair of hydraulic lift cylinders 16.

A main tubular force absorbing torque tube or crossbeam 18, having a pair of forwardly extending end plates 20 mounted on laterally spaced opposite ends, is attached by a pair of pins 22 to the spaced legs 12 of the support frame 11 and is pivoted thereabout. A pair of hydraulic tilt cylinders 24 are positioned between the end plates 20 and the bracket 14 to pivot the crossbeam 18 about the pins 22.

A pair of impactor mounting plates 26 are mounted on the crossbeam 18 in inwardly spaced relation to each pair of end plates 20. The impactor mounting plates 26 extend rearwardly downwardly from the crossbeam 18.

A pair of ripper shank mounting plates 28 are mounted on the crossbeam 18 between the pair of impactor mounting plates 26. The ripper shank mounting plates 26 extend forwardly from the crossbeam 18 between the spaced legs 12 of the support frame 11.

A ripper shank 29 having a rear impact surface 30 and a front apex 32 is pivotally connected by a shank pivot mounting 34 to the pair of ripper shank mounting plates 28 slightly ahead of the pivotal connection 22 of the end plates 20 with the legs 12 of the support frame 11 for directing ground engaging forces into the crossbeam 18. The impact surface 30 defines a plane 36 which extends through the pivot pin 34 axis.

A carrier 38 having a first side plate 40 and a second side plate 42 fastened together by a plurality of bolts 44 is removably attached by a front support pin 46 and a rear support pin 48 to the pair of impactor mounting plates 26 below the crossbeam 18. The side plates 40 and 42 have a plurality of apertures 50 for receiving a plurality of mounting blocks 52.

A linear reciprocating impact hammer 54 having an axis of actuation 56 is cradled within and mounted to the carrier 38 by the mounting block 52. The impact hammer 52 is positioned at a preselected inclined angular attitude to strike the impact surface 30 of the ripper shank 29.

Figure 4:
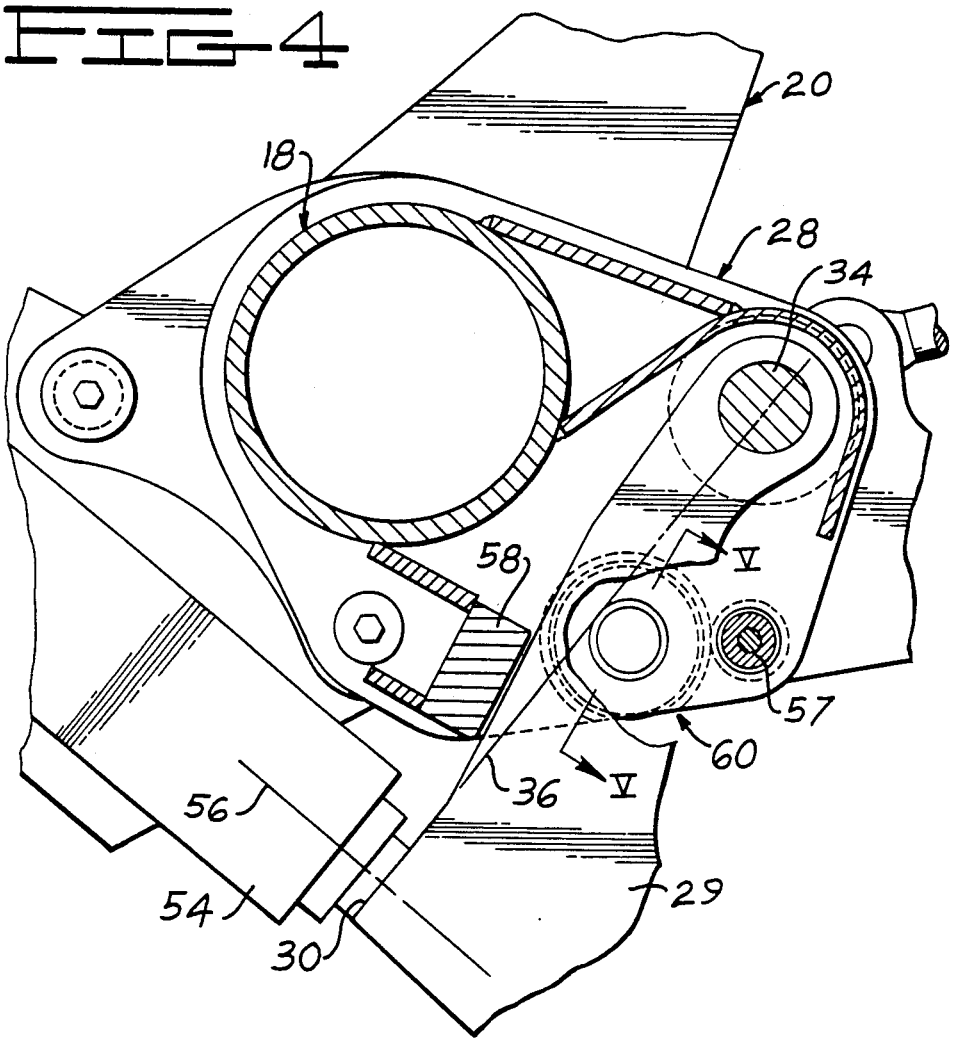
FIG. 4 is a partial side sectional view taken along plane IV—IV of FIG. 2.
Figure 6:
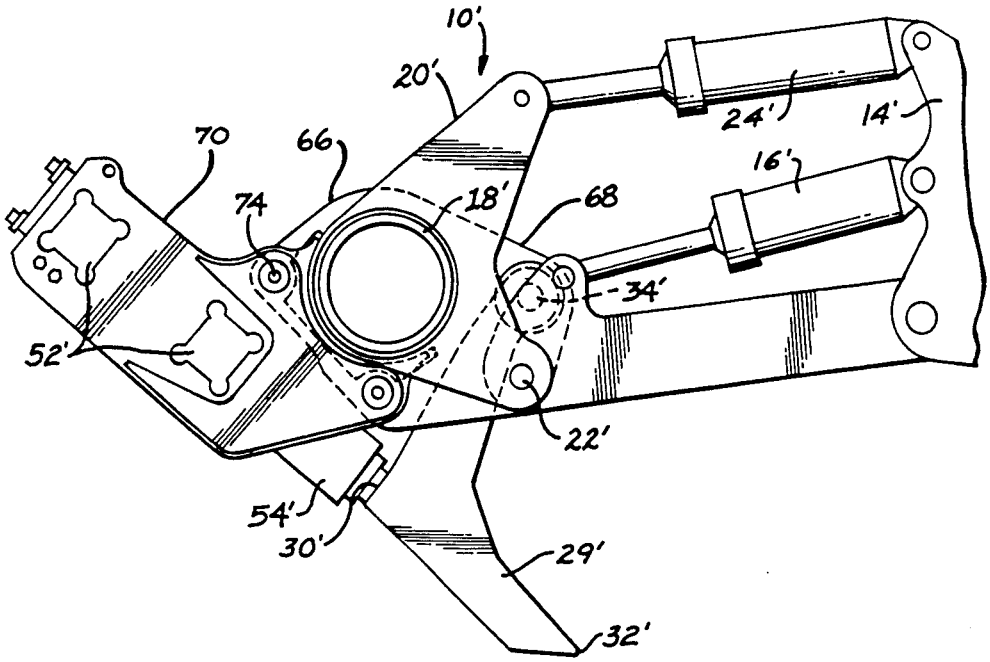
FIG. 6 is a side elevational view of an alternate embodiment of a mounting frame for a linear impact ripper assembly.
Figure 7:
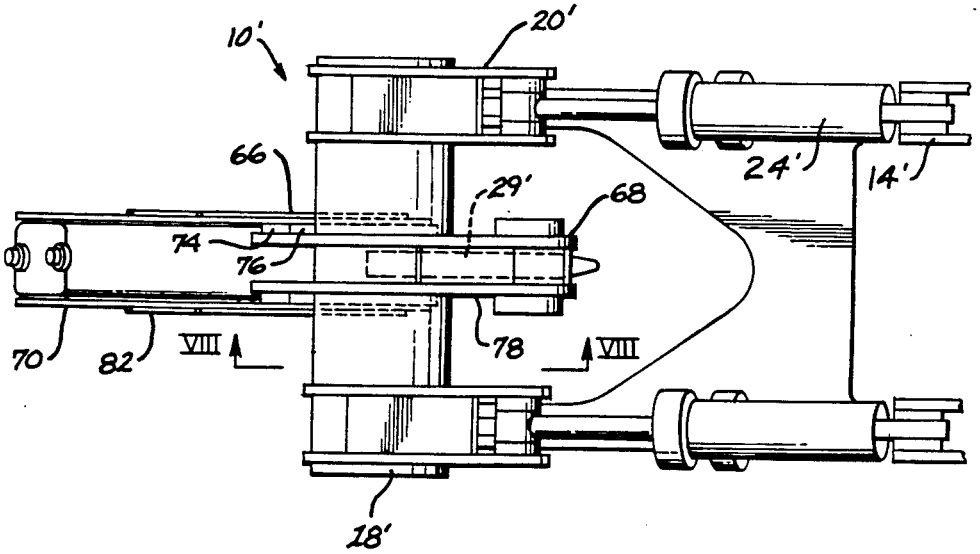
FIG. 7 is a top elevational view of the alternate embodiment of the mounting frame for a linear impact ripper assembly.
Figure 8:
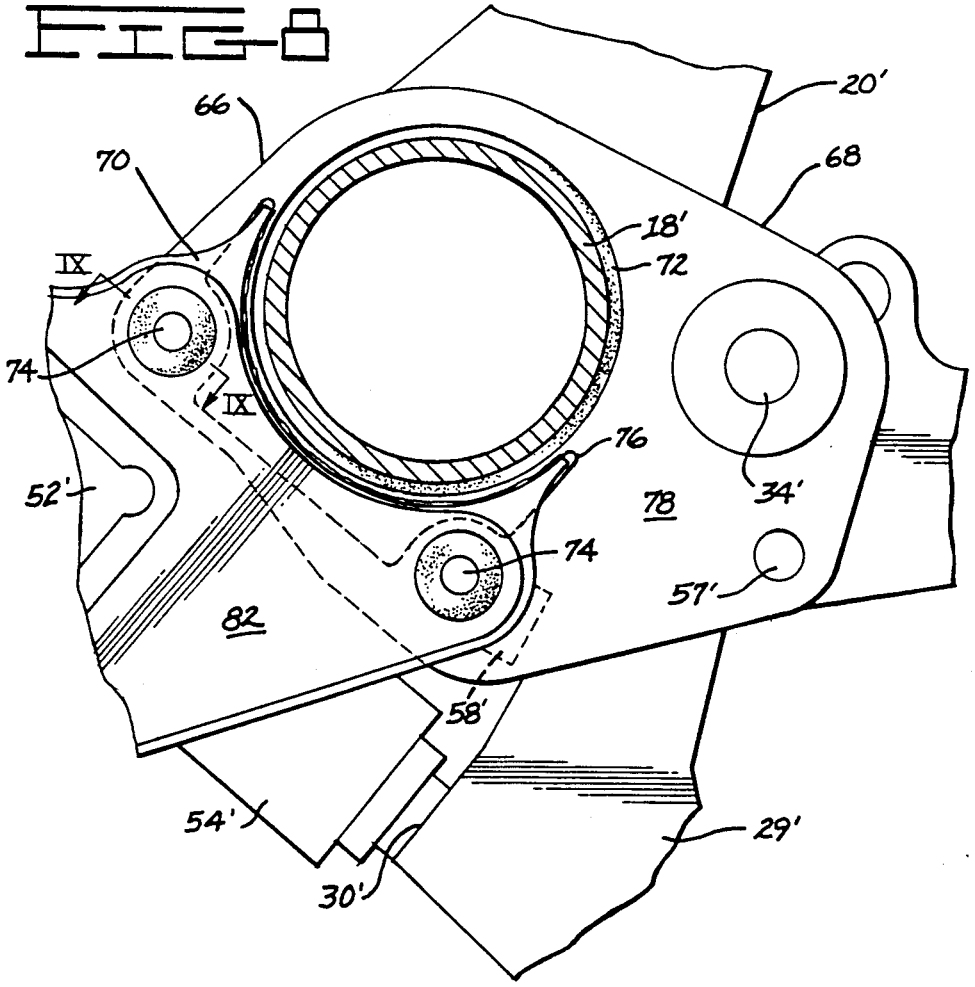
FIG. 8 is a partial side sectional view taken along plane VIII—VIII of FIG. 7.
Figure 9:
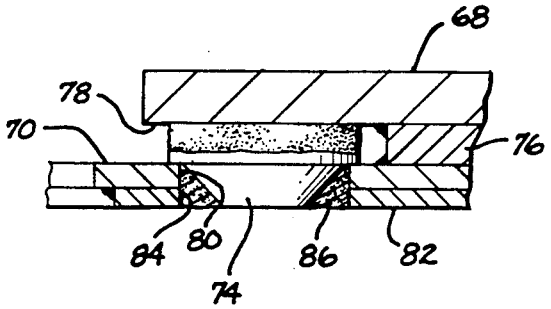
FIG. 9 is a fragmentary sectional view taken along plane IX—IX of FIG. 8.

Referring now more specifically to FIG. 4, the pair of ripper shank mounting plates 28 provide a front stop 57 which limits forward pivotal motion of the ripper shank 29, and a rear stop 58 to limit rearward pivotal motion of the ripper shank 29. The ripper shank mounting plates 28 also provide a lateral stabilizer assembly 60 to reduce lateral forces on the ripper shank 29 and transfer the lateral forces into the crossbeam 18.

Figure 5:
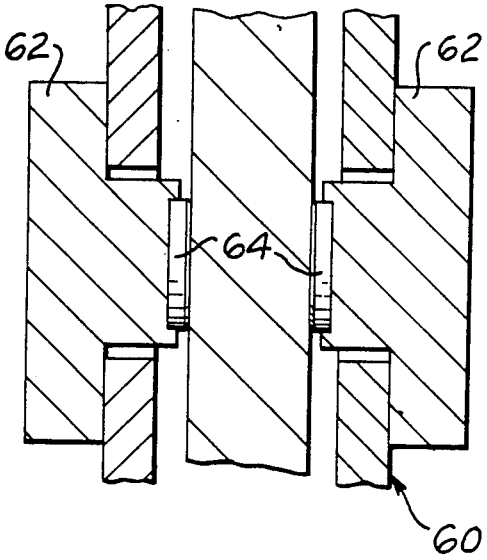
FIG. 5 is a fragmentary sectional view taken along plane V—V of FIG. 4.

Referring now to FIG. 5, the lateral stabilizer assembly 60 comprises a pair of holding blocks 62 each maintaining a replaceable thrust washer 64 in close proximity to the ripper shank 29. The thrust washer 64 limits lateral movement of the ripper shank 29.

Referring now to an alternate embodiment as disclosed in FIG. 6 to FIG. 9, structure which is identical in both embodiments will use the same reference numeral with a prime added in the alternate embodiment.

In the illustrated embodiment the mounting frame 10' includes a mounting structure 66 mounted on the crossbeam 18' intermediate the end plates 20' which are mounted on laterally spaced opposite ends of the crossbeam 18'.

The mounting structure 66 includes a pair of ripper shank mounting plates 68 mounted on the crossbeam 18' and a pair of impactor mounting plates 70 mounted outwardly on the ripper shank mounting plates 68. The pair of impactor mounting plates 70 straddle the pair of ripper shank mounting plates 68. The pair of ripper shank mounting plates 68 are attached to the crossbeam 18' by a weld 72. A plurality of bosses 74 and a spacer plate 76 are attached to an outer surface 78 of the shank mounting plate 68. The impactor mounting plates 70 have a plurality of apertures 80 for receiving the plurality of bosses 74 to position the impactor mounting plates. A pair of stiffener plates 82 are attached to the impactor mounting plates 70 and have a plurality of apertures 84 for also receiving the plurality of bosses 74. A plurality of welds 86 attach the mounting plates 70 and stiffener plates 82 to the plurality of bosses 74. The pair of impactor mounting plates 70 are considered to be mounted on the crossbeam 18' by virtue of their being mounted on the pair of ripper shank mounting plates 68 which are mounted on the crossbeam 18'.

INDUSTRIAL APPLICABILITY

The linear impact ripper mounting structure, 10' may be utilized as an impact energy source such as is typically mounted to a bracket, 14' at the rear of an earthworking vehicle (not shown). During forward movement of the ripper structure, 10', the apex, 32' of the ripper shank, 29' is selectively engageable with the earth. As the ripper structure, 10' moves forward, the ripper shank, 29' is pivoted rearwardly about the pivot pin, 30' until the impact surface, 30' of the shank, 29' contacts the liner reciprocating impact hammer, 54'. The impact hammer, 54' strikes the impact surface, 30' driving the shank, 29' forward with the apex, 32' breaking rock.

Forward movement pivots the ripper shank, 29' rearward putting force on the ripper shank, 29' which is transferred into the impact hammer, 54'. As force on the ripper shank, 29' and impact hammer, 54' increases, the mounting blocks, 52' will deflect to allow the impact hammer, 54' to move rearward. As the ripper shank, 29' and impact hammer, 54' move rearward, the ripper shank, 29' will contact the rear stop, 58', therefore transferring all forces over a predetermined level away from the impact hammer, 54' into the impactor mounting plates, 26' and crossbeam, 18' which serves to absorb such forces and isolate any resulting shock from the hydraulic jacks, 16' and, 24' and the frame mounting bracket, 14' on the vehicle.

It should now be apparent that the linear impact ripper structure, 10' transfers forces into the crossbeam, 18'.

Other apsects, objects and advantages of this invention can be obtained from a study of the drawings, the disclosure and the appended claims.

We claim:

1. A mounting frame adapted for supporting an impact ripper on a vehicle providing an elevationally adjustable support frame having a pair of rearwardly extended transversely spaced legs, said impact ripper including a ripper shank for engaging the ground and an impactor, comprising:

a main crossbeam having laterally spaced opposite ends;

a pair of end plates mounted on each end of the crossbeam and forwardly extended therefrom for pivotal connection to said legs of the support frame;

a pair of impactor mounting plates mounted on said crossbeam in inwardly spaced relation from each of said pairs of end plates and rearwardly downwardly extended from the crossbeam in trailing relation thereto;

a pair of ripper shank mounting plates mounted on said crossbeam between said pair of impactor mounting plates in forwardly extended relation from the crossbeam between said legs of the support frame; and a shank pivot mounting on said shank mounting plates and adapted for supporting the ripper shank in depending relation therefrom.

2. The mounting frame of claim 1 including stop means mounted between said shank mounting plates in downwardly spaced relation to said shank pivot mounting to limit fore and aft swinging movement of the shank and adapted to transfer ground engaging forces on the shank which exceed a predetermined level into said shank mounting plates and said crossbeam.

3. The mounting frame of claim 2 wherein said stop means provide a forward stop and a rearward stop.

4. The mounting frame of claim 1 wherein the ripper shank mounting plates provide a lateral stabilizing means for preventing lateral deflection of a ripper shank.

5. A mounting frame and ripper assembly for mounting an impact ripper on a vehicle providing an elevationally adjustable support frame having a pair of rearwardly extended transversely spaced legs, comprising:

a main tubular crossbeam;

a linear reciprocating impact hammer having an axis of actuation;

a ripper shank having a rear impact surface and a front apex;

first means for releasably and pivotally supporting the ripper shank on the crossbeam with the axis of actuation of the impact hammer in substantial alignment with the rear impact surface and the front apex of the ripper shank, said rear impact surface defining a plane which extends through said first means; and second means for laterally stabilizing the ripper shank and transferring lateral forces into the crossbeam, said second means being located intermediate said first means and said rear impact surface.

6. The mounting frame and ripper assembly of claim 5 including a pair of ripper shank mounting plates mounted on said crossbeam, and stop means mounted between said shank mounting plates in downwardly spaced relation to said first means to limit fore and aft swinging movement of the shank to transfer ground engaging forces on the shank which exceed a predetermined level into said shank mounting plates and said main tubular crossbeam.

7. A mounting frame adapted for supporting an impact ripper on a vehicle providing an elevationally adjustable support frame having a pair of rearwardly extended transversely spaced legs, said impact ripper including a ripper shank for engaging the ground and an impactor, said mounting frame comprising:

a main crossbeam having laterally spaced opposite ends;

a pair of end plates mounted on each end of the crossbeam and forwardly extended therefrom and adapted for pivotal connection to the legs of the support frame;

a pair of ripper shank mounting plates mounted on said crossbeam intermediate said end plates in forwardly extended relation from the crossbeam;

a pair of impactor mounting plates mounted on said crossbeam outwardly of said ripper shank mounting plates in rearwardly extending relation thereto; and a shank pivot mounting on said shank mounting plates and adapted for supporting the ripper shank in depending relation therefrom.

8. A mounting frame adapted for supporting an impact ripper on a vehicle providing an elevationally adjustable support frame having a pair of rearwardly extended transversely spaced legs, said impact ripper including a ripper shank for engaging the ground and an impactor, said mounting frame comprising:

a main crossbeam having laterally spaced opposite ends;

a pair of end plates mounted on each end of the crossbeam and forwardly extended therefrom and adapted for pivotal connection to the legs of the support frame;

a pair of ripper shank mounting plates mounted on said crossbeam intermediate said end plates in forwardly extended relation from the crossbeam;

a pair of impactor mounting plates mounted on one of said crossbeam and said pair of ripper shank mounting plates outwardly of said ripper shank mounting plates in rearwardly extending relation thereto; and a shank pivot mounting on said shank mounting plates and adapted for supporting the ripper shank in depending relation therefrom.

9. A mounting frame adapted for supporting an impact ripper on a vehicle providing an elevationally adjustable support frame having a pair of rearwardly extended transversely spaced legs, said impact ripper including a ripper shank for engaging the ground and an impactor, said mounting frame comprising:

a main crossbeam having laterally spaced opposite ends;

a pair of end plates mounted on each end of the crossbeam and forwardly extended therefrom and adapted for pivotal connection to said legs of the support frame;

a mounting structure mounted on said crossbeam intermediate said pairs of end plates, said mounting structure includes a pair of ripper shank mounting plates mounted on said crossbeam in forwardly extended relation from the crossbeam and a pair of impactor mounting plates mounted outwardly on said pair of ripper shank mounting plates in rearwardly extending relation thereto; and a shank pivot mounting on said shank mounting plates and adapted for supporting the ripper shank in depending relation therefrom.

10. The mounting frame of claim 9 wherein said pair of impactor mounting plates straddle said pair of ripper shank mounting plates.

* * * * *